US007623102B2

(12) United States Patent
Matsumoto

(10) Patent No.: US 7,623,102 B2
(45) Date of Patent: Nov. 24, 2009

(54) ACTIVE MATRIX TYPE DISPLAY DEVICE

(75) Inventor: Shoichiro Matsumoto, Gifu (JP)

(73) Assignee: Sanyo Electric Co., Ltd., Osaka (JP)

( * ) Notice: Subject to any disclaimer, the term of this patent is extended or adjusted under 35 U.S.C. 154(b) by 630 days.

(21) Appl. No.: 11/372,487

(22) Filed: Mar. 10, 2006

(65) Prior Publication Data

US 2006/0214889 A1 Sep. 28, 2006

(30) Foreign Application Priority Data

Mar. 11, 2005 (JP) ..... 2005-068813
Feb. 6, 2006 (JP) ..... 2006-027915

(51) Int. Cl.
*G09G 3/32* (2006.01)

(52) U.S. Cl. ..... 345/82; 345/76

(58) Field of Classification Search ..... 345/76, 345/82

See application file for complete search history.

(56) References Cited

U.S. PATENT DOCUMENTS

| | | | | |
|---|---|---|---|---|
| 5,828,368 | A * | 10/1998 | Jung | 345/213 |
| 7,167,169 | B2 | 1/2007 | Libsch et al. | |
| 7,230,591 | B2 | 6/2007 | Inukai | |
| 2001/0007447 | A1 | 7/2001 | Tanaka et al. | |
| 2002/0140645 | A1* | 10/2002 | Sato et al. | 345/82 |
| 2002/0180671 | A1* | 12/2002 | Inukai | 345/76 |
| 2003/0090447 | A1* | 5/2003 | Kimura | 345/82 |
| 2003/0173904 | A1 | 9/2003 | LeChevalier | |
| 2004/0026723 | A1* | 2/2004 | Miyazawa | 257/277 |
| 2004/0113872 | A1* | 6/2004 | Nanno et al. | 345/76 |
| 2004/0179005 | A1 | 9/2004 | Jo | |
| 2004/0252084 | A1* | 12/2004 | Miyagawa et al. | 345/76 |
| 2005/0068270 | A1* | 3/2005 | Awakura et al. | 345/76 |
| 2005/0078065 | A1 | 4/2005 | Hayafuji et al. | |
| 2005/0156921 | A1 | 7/2005 | Nguyen | |
| 2006/0001616 | A1 | 1/2006 | Chang | |
| 2006/0139254 | A1 | 6/2006 | Hayakawa et al. | |
| 2006/0145960 | A1 | 7/2006 | Koga et al. | |
| 2006/0208976 | A1 | 9/2006 | Ikeda | |
| 2006/0226788 | A1 | 10/2006 | Ogawa | |

FOREIGN PATENT DOCUMENTS

| | | |
|---|---|---|
| JP | 2002-175035 | 6/2002 |
| JP | 2004-341435 | 12/2004 |

* cited by examiner

*Primary Examiner*—Richard Hjerpe
*Assistant Examiner*—Andrew Schnirel
(74) *Attorney, Agent, or Firm*—Morrison & Foerster LLP

(57) ABSTRACT

A variation in a display image and duration of a residual image are reduced to improve quality of display of an active matrix type display device. A control circuit sequentially outputs a pre-charge pulse signal PCG1 and a storage capacitor control pulse signal SC1 in synchronization with a falling edge of a vertical start pulse signal STV. A pre-charge TFT in a pixel in a first row is turned on according to the pre-charge pulse signal PCG1. As a result, a source and a gate of a driver TFT are short-circuited, both an electric potential at the gate and an electric potential at the source of the driver TFT become a positive power supply electric potential PVdd, and the driver TFT is turned off. After that, the storage capacitor control pulse signal SC1 rises to a high level, and the electric potential at the gate of the driver transistor is raised by capacitive coupling. With this, electric characteristics of the driver TFT are initialized.

14 Claims, 11 Drawing Sheets

ACTIVE MATRIX TYPE DISPLAY DEVICE

CROSS-REFERENCE OF THE INVENTION

This invention is based on Japanese Patent Applications No. 2005-068813 and No. 2006-027915, the content of which is incorporated herein by reference in its entirety.

BACKGROUND OF THE INVENTION

1. Field of the Invention

This invention relates to an active matrix type display device that has a light-emitting device such as an organic electroluminescent device (hereafter referred to as an organic EL device).

2. Description of the Related Art

Organic EL display devices using organic EL devices have been developed in recent years as display devices to replace CRT and LCD. An emphasis is laid on development of an active matrix type organic EL display device that uses a thin film transistor (hereafter referred to as a TFT) as a switching device to drive the organic EL device.

The active matrix type organic EL display device will be explained hereinafter, referring to the drawing. FIG. 9 is an equivalent circuit diagram of the organic EL display device. Only one pixel 210 is shown in FIG. 9 out of a plurality of pixels arrayed in a matrix form in a display panel of the organic EL display device. An N-channel type pixel selection TFT 213 is disposed around an intersection of a pixel selection signal line 211 extending in a row direction and a display signal line 212 extending in a column direction. A gate of the pixel selection TFT 213 is connected to the pixel selection signal line 211, while a drain of the pixel selection TFT 213 is connected to the display signal line 212. The pixel selection TFT 213 is turned on according to a high level of a pixel selection signal G, which is outputted from a vertical drive circuit 301 and applied to the pixel selection signal line 211. A display signal D is outputted from a horizontal drive circuit 302 to the display signal line 212.

A source of the pixel selection TFT 213 is connected to a gate of a P-channel type driver TFT 214. A source of the driver TFT 214 is connected to a power supply line 215 that supplies a positive power supply electric potential PVdd. A drain of the driver TFT 214 is connected to an anode of an organic EL device 216. A negative power supply electric potential CV is supplied to a cathode of the organic EL device 216.

A storage capacitor 218 is connected between the gate of the driver TFT 214 and a capacitor line 217. The capacitor line 217 is connected to a fixed electric potential. The storage capacitor 218 retains the display signal D applied to the gate of the driver TFT 214 through the pixel selection TFT 213 for one vertical period.

Next, operation of the organic EL display device described above will be explained. The pixel selection TFT 213 is turned on when the high level of the pixel selection signal G, which lasts for one horizontal period, is applied to the pixel selection line 211. Then the display signal D outputted to the display signal line 212 is applied to the gate of the driver TFT 214 through the pixel selection TFT 213 and retained by the storage capacitor 218. In other words, the display signal D is written into the pixel 210.

A conductance of the driver TFT 214 varies according to the display signal D applied to the gate of the driver TFT 214. When the driver TFT 214 is turned on, it provides the organic EL device 216 with an electric current corresponding to the conductance and the organic EL device 216 is driven to a brightness level corresponding to the electric current. On the other hand, when the driver TFT 214 is turned off accordingly to the display signal D supplied to its gate, the organic EL device 216 is extinguished because no electric current flows through the driver TFT 214. A desired image can be displayed on the entire display panel by performing the operation described above for all the rows of the display pixels 210 over one vertical period.

With the organic EL display device described above, however, there are problems of a variation in brightness on the display panel and a residual image of moving picture. A method to reduce the variation in brightness and the residual image of moving picture by controlling a light-emitting period of the organic EL device 216 using a scanning-related signal (the pixel selection signal G for example) of the vertical drive circuit 301 is known, as disclosed in Japanese Patent Application Publication No. 2002-175035. Assuming that a display area on the display panel is composed of pixels arrayed in a matrix with m rows and n columns and that the light-emitting period is a half of the vertical period for example, the organic EL device 216 is extinguished in synchronization with a rise of the pixel selection signal G on the (n/2)th row of the pixel selection signal line 211, according to the method.

However, the method disclosed in the Japanese Patent Application Publication No. 2002-175035 sets the light-emitting period using hardware. Thus, once the light-emitting period is set, changing the light-emitting period is not possible unless a connection of a wiring is physically modified. Modifying the connection of the wiring requires a change in a photomask for wiring, which causes problems of an additional cost for the photomask, an additional cost to manufacture a modified display panel and additional manufacturing time.

SUMMARY OF THE INVENTION

An active matrix type display device of this invention has a plurality of pixels arrayed in a matrix form, each of the pixels including a pixel selection transistor, a light-emitting device and a driver transistor that drives the light-emitting device according to a display signal provided through the pixel selection transistor, and a control circuit that controls turning-on/off of the driver transistor according to a vertical start pulse signal for commencement of vertical scanning.

DETAILED DESCRIPTION OF THE INVENTION

Figure 1:
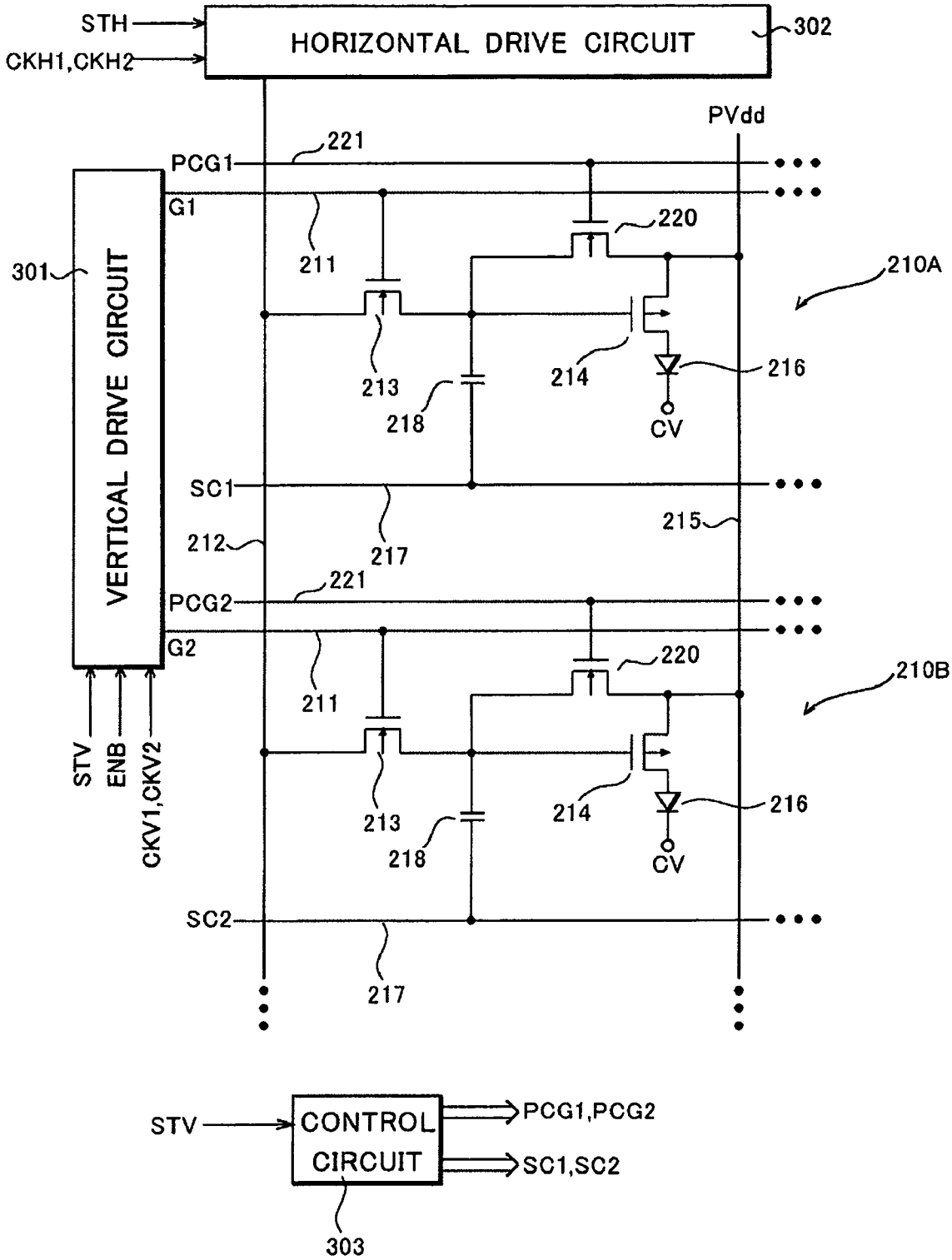
FIG. 1 is an equivalent circuit diagram of an organic EL display device according to a first embodiment of this invention.
Figure 9:
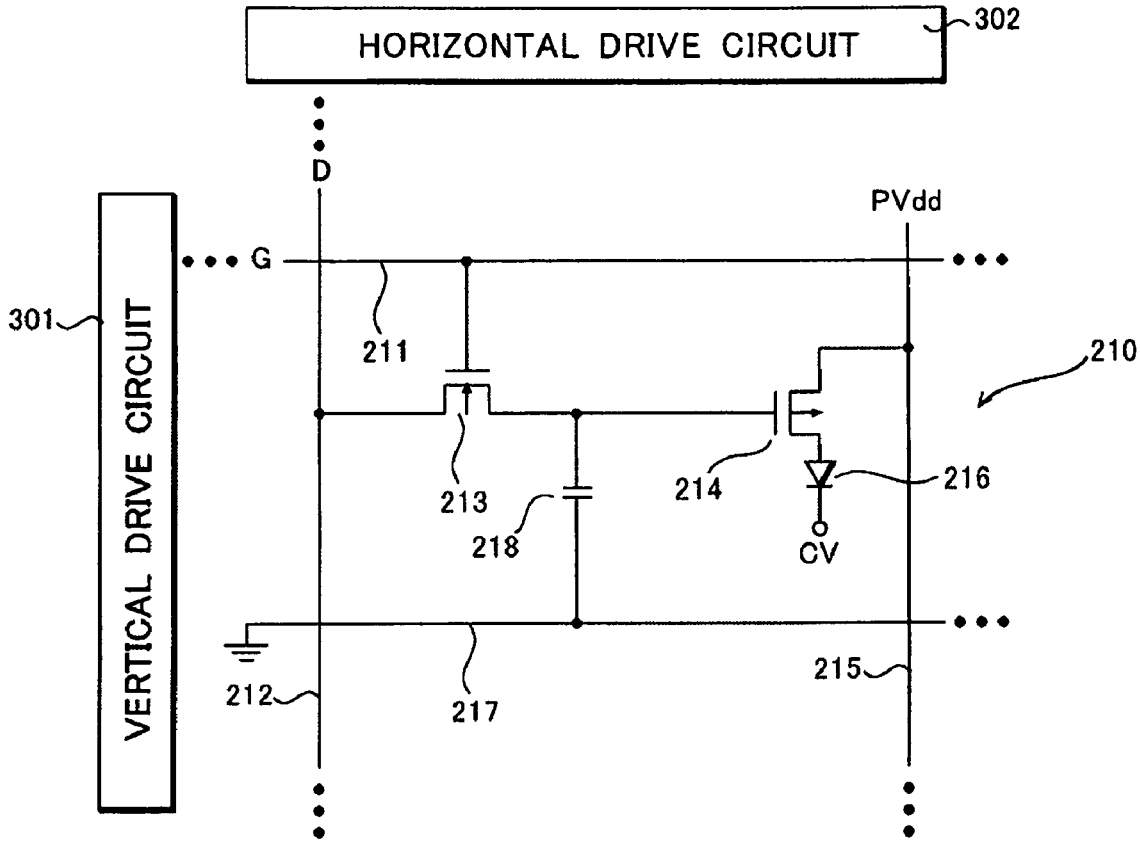
FIG.9 PRIOR ART
FIG. 9 is an equivalent circuit diagram showing an organic EL display device according to a prior art.

An active matrix type organic EL display device according to a first embodiment of this invention will be described hereafter referring to the drawings. FIG. 1 is an equivalent circuit diagram of the organic EL display device. FIG. 1 shows only a pixel 210A in a first row and a pixel 210B in a second row out of a plurality of pixels arrayed in a matrix form in a display panel of the organic EL display device. The pixels 210A and 210B are aligned in a column direction next to each other. The same components in FIG. 1 as in FIG. 9 are denoted by the same symbols, and the explanations thereof are omitted. It is assumed in the following explanation that a pixel selection TFT 213 and a pre-charge TFT 220 are of N-channel type and a driver TFT 214 is of P-channel type. However, this embodiment is not limited to the channel conductivity types mentioned above.

The pre-charge TFT 220 is connected between a source and a gate of the driver TFT 214 in the pixel 210A. A gate of the pre-charge TFT 220 is connected to a pre-charge signal line 221. A pre-charge pulse signal PCG1 is supplied to the pre-charge signal line 221, and the pre-charge TFT 220 is turned on and off according to the pre-charge pulse signal PCG1. The source and the gate of the driver TFT 214 are short-circuited when the pre-charge TFT 220 is turned on. With this, the driver TFT 214 is turned off, because both an electric potential at the source and an electric potential at the gate of the driver TFT 214 are set to the same electric potential that is a positive power supply electric potential PVdd. The source and the gate of the driver TFT 214 is electrically disconnected when the pre-charge TFT 220 is turned off. A capacitor line 217 is not connected to a fixed electric potential as in the prior art. Instead, it is provided with a storage capacitor control pulse signal SC 1 that is turned to a high level during a predetermined period that will be described below.

Although the pixel 210B is structured similarly, the pre-charge signal line 221 is provided with a pre-charge pulse signal PCG2 and the capacitor line 217 is provided with a storage capacitor control pulse signal SC2.

A vertical drive circuit 301 shifts a vertical start pulse signal STV, which is a reference signal of commencement of vertical scanning, in synchronization with vertical clocks CKV1 and CKV2, which are complementary to each other, to generate pixel selection signals G1 and G2. The pixel selection signal G1 is applied to a gate of the pixel selection TFT 213 in the pixel 210A through a pixel selection signal line 211, while the pixel selection signal G2 is applied to a gate of the pixel selection TFT 213 in the pixel 210B through the pixel selection line 211. An enable signal ENB controls a timing at which the pixel selection signal G1 is outputted to the pixel selection signal line 211 and is used to prevent overlapping of the pixel selection signals G1 and G2.

A horizontal drive circuit 302 shifts a horizontal start pulse signal STH in synchronization with horizontal clocks CKH1 and CKH2, which are complementary to each other, to generate horizontal scanning signals. And the horizontal drive circuit 302 outputs display signals D to display signal lines 212 in synchronization with the horizontal scanning signals.

A control circuit 303 generates the pre-charge pulse signals PCG1 and PCG2 and the storage capacitor control pulse signals SC1 and SC2 in synchronization with a falling edge of the vertical start pulse signal STV. Although the control circuit 303 is disposed outside the vertical drive circuit 301 in FIG. 1, it may be disposed inside the vertical drive circuit 301 either.

Figure 2:
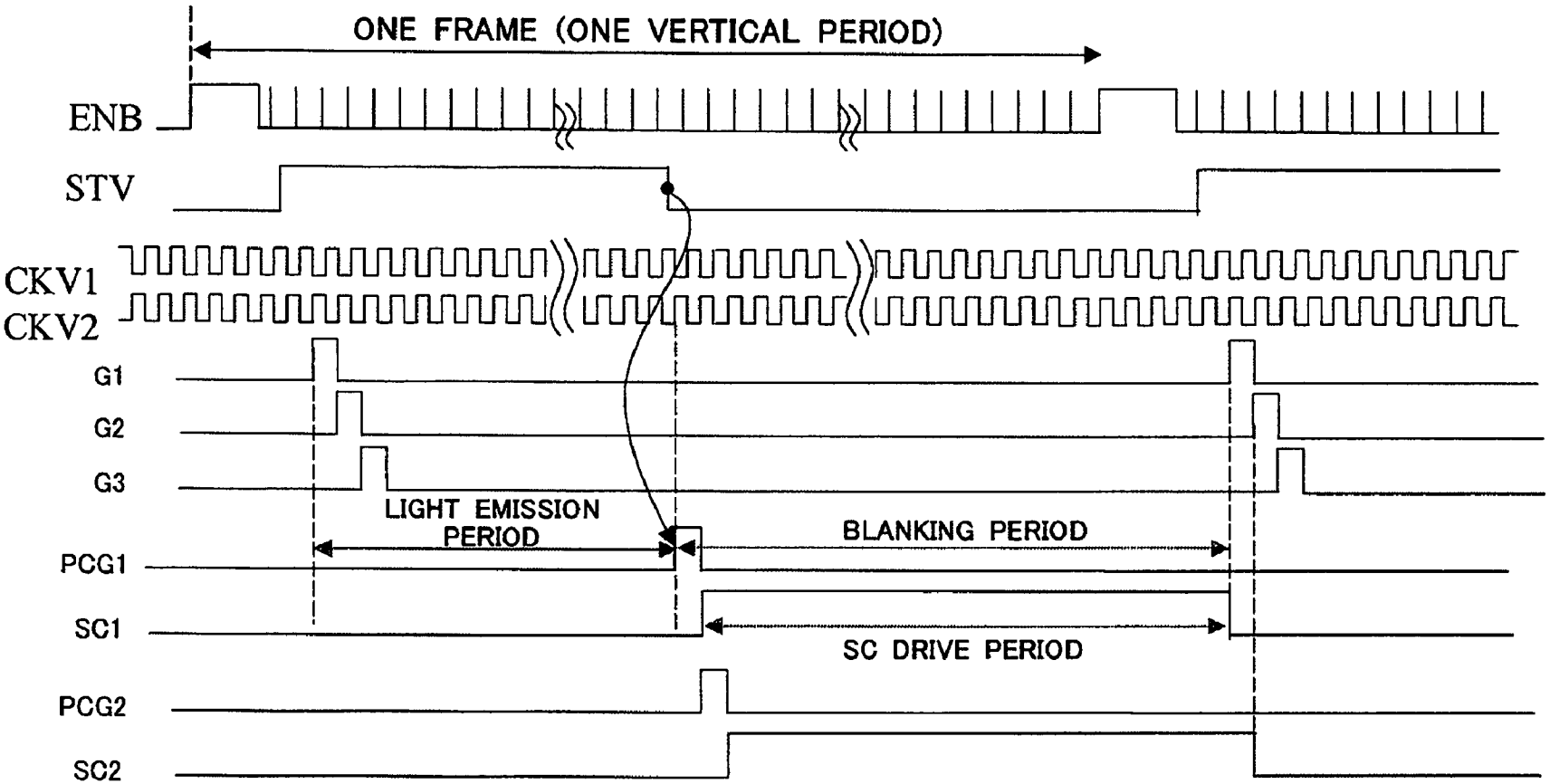
FIG. 2 is a timing chart showing a method to drive the organic EL display device according to the first embodiment of this invention.

Next, a driving method of the organic EL display device described above will be explained referring to the drawings. FIG. 2 is a timing chart to explain the driving method of the organic EL display device according to the first embodiment. The pixel selection signals G1, G2 and G3 are sequentially outputted from the vertical drive circuit 301 in synchronization with a rising edge of the vertical start pulse signal STV.

The pixel selection TFT 213 in the pixel 210A in the first row is turned on according to a high level of the pixel selection signal G1 for one horizontal period, during which the display signal D is outputted to the display signal line 212 and applied to the gate of the driver TFT 214 through the pixel selection TFT 213 as well as stored in a storage capacitor 218. In other words, the display signal D is written into the pixel 210A. When the driver TFT 214 is turned on according to the display signal D applied to the gate of the driver TFT 214, it provides the organic EL device 216 with an electric current corresponding to a conductance of the driver TFT 214 and drives the organic EL device 216 to a brightness level corresponding to the electric current.

The pixel selection TFT 213 is turned off when the pixel selection signal G1 resumes to a low level at an end of the horizontal period. However, the organic EL device 216 continues to emit light because the display signal D is maintained by the storage capacitor 218. That is, a light-emitting period of the pixel 210A in the first row begins according to a rising edge of the pixel selection signal G1, a light-emitting period of the pixel 210B in the second row begins according to a rising edge of the pixel selection signal G2 and a light-emitting period of a pixel in a third row begins according to a rising edge of the pixel selection signal G3.

After that, the control circuit 303 sequentially outputs the pre-charge pulse signals PCG1 and PCG2 and the storage capacitor control pulse signals SC1 and SC2 in synchronization with the falling edge of the vertical start pulse signal STV. The pre-charge TFT 220 in the pixel 210A in the first row is turned on according to a high level of the pre-charge pulse signal PCG1. As a result, the source and the gate of the driver TFT 214 are short-circuited, both the electric potential at the gate and the electric potential at the source of the driver TFT 214 become the same electric potential that is the positive power supply electric potential PVdd, and the driver TFT 214 is turned off. With this, the organic EL device 216 is extinguished to terminate the light-emitting period and commence a non-light-emitting period that lasts until the pixel selection signal G1 turns to the high level in a subsequent vertical period.

After that, when the pre-charge pulse signal PCG1 turns to a low level, the pre-charge TFT 220 is turned off to disconnect the source and the gate of the driver TFT 214. At the same time or later, the storage capacitor control pulse signal SC1 turns to the high level. Then the electric potential at the gate of the driver TFT 214 is raised by capacitive coupling through the storage capacitor 218 according to a voltage change ΔV (about 10V, for example) from the low level to the high level of the storage capacitor control pulse signal SC1.

As a result, the electric potential at the gate of the driver transistor 214 becomes higher than the electric potential at its source. Assuming that carriers (holes) are trapped in a gate insulation film of the driver TFT 214 by writing-in of the display signal D during a preceding period, the carriers (holes) are extracted from the gate insulation film to the source or a drain as a tunnel current induced by an electric field from the gate to the source or the drain. With this, electric characteristics of the driver TFT 214 are initialized. As a result, an appropriate value of electric current corresponding to the display signal D flows through the driver TFT 214 when the display signal D is written into the pixel 210A in the subsequent vertical period.

Similarly, the light-emitting period of the pixel 210B in the second row begins at the rising edge of the pixel selection signal G2. After the pre-charge pulse signal PCG1 for the first row has turned to the low level, the pre-charge TFT 220 in the pixel 210B is turned on when the pre-charge pulse signal PCG2 for the second row rises. After that, when the pre-charge pulse signal PCG2 turns to the low level, the pre-charge TFT 220 is turned off to disconnect the source and the gate of the driver TFT 214. At the same time or later, the storage capacitor control pulse signal SC2 turns to the high level. Then the electric potential at the gate of the driver TFT 214 is raised by capacitive coupling through the storage capacitor 218 according to the voltage change ΔV from the low level to the high level of the storage capacitor control pulse signal SC2. With this, electric characteristics of the driver TFT 214 are initialized. The operation is similar with the pixels in the third row and in the rest of the rows.

According to the embodiment, the light-emitting period and the non-light emitting period of the organic EL device 216 in each of the pixels can be adjusted freely by controlling a pulse width of the vertical start pulse signal STV, without changing the photomask as in the prior art. The variation in brightness on the display panel and duration of the residual image of moving picture can be reduced to improve quality of moving picture display by the adjustment described above. Also, the residual image on the display panel can be further suppressed by providing the capacitor line 217 with the high level of the storage capacitor control pulse signal SC1 to optimize the initialization of the electric characteristics of the driver TFT 214.

Figure 3:
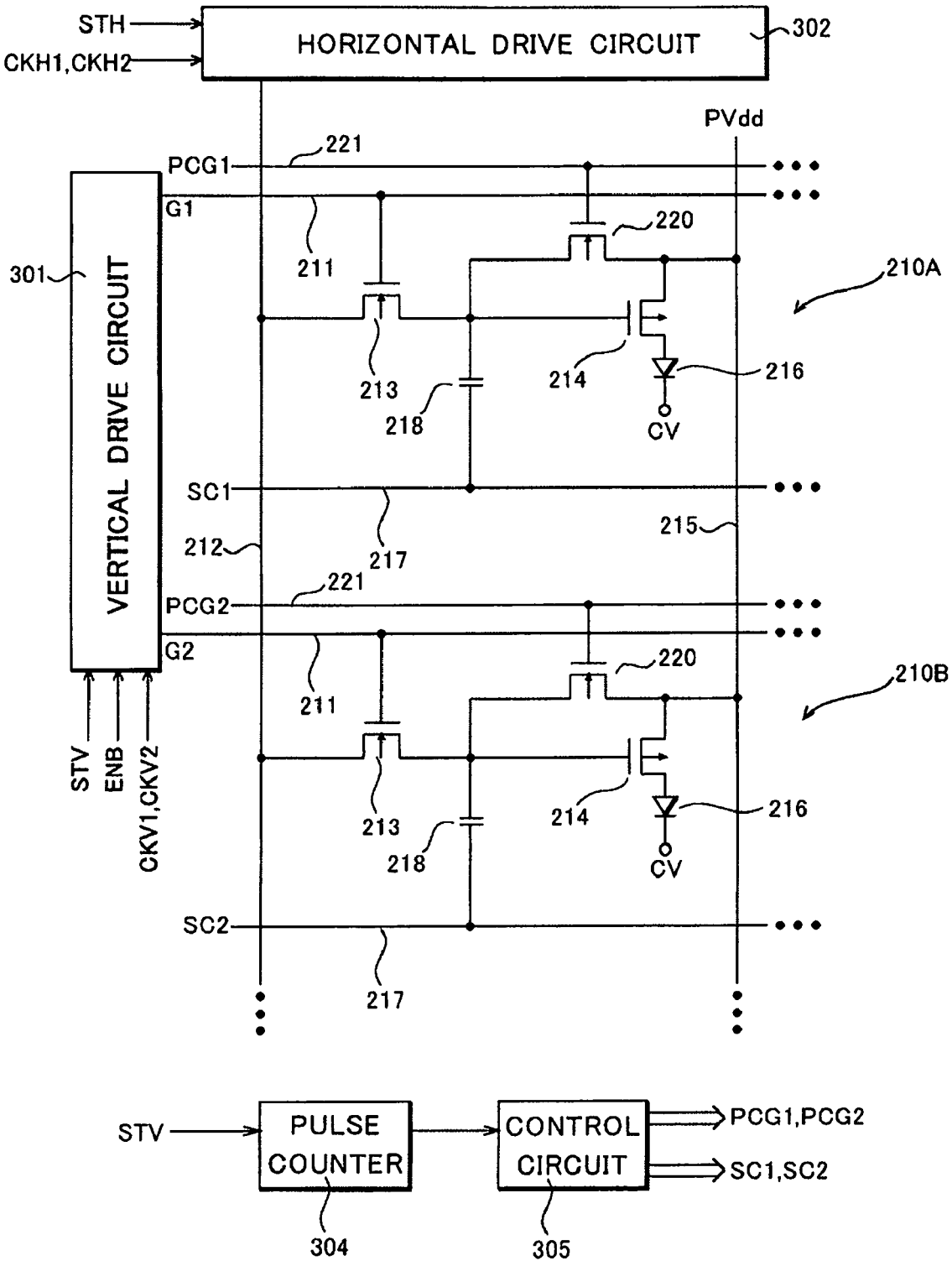
FIG. 3 is an equivalent circuit diagram of an organic EL display device according to a second embodiment of this invention.

An active matrix type organic EL display device according to a second embodiment of this invention will be described hereafter referring to the drawings. FIG. 3 is an equivalent circuit diagram of the organic EL display device. FIG. 3 shows only a pixel 210A in a first row and a pixel 210B in a second row out of a plurality of pixels arrayed in a matrix form in a display panel of the organic EL display device. The pixels 210A and 210B are aligned in a column direction next to each other. The same components in FIG. 3 as in FIG. 9 are denoted by the same symbols, and the explanations thereof are omitted.

In the first embodiment, duration of the light-emitting period and the non-light-emitting period of the organic EL device 216 in each of the pixels is adjusted through the use of the pulse width of the vertical start pulse signal STV while the electric characteristics of the driver TFT 214 are initialized during the non-light-emitting period. In the second embodiment, on the other hand, the light-emitting period and the non-light-emitting period are adjusted by inputting two vertical start pulse signals STV during one vertical period so as to generate the pre-charge pulse signals PCG1 and PCG2 and the storage capacitor control pulse signals SC1 and SC2 in synchronization with the two vertical start pulse signals STV.

The organic EL display device of the second embodiment has a pulse counter 304 that counts a number of the vertical start pulse signals STV, as shown in FIG. 3. When the pulse counter 304 counts two vertical start pulse signals STV, a control circuit 305 generates the pre-charge pulse signals PCG1 and PCG2 and the storage capacitor control pulse signals SC1 and SC2 based on the count. Although the pulse counter 304 and the control circuit 305 are disposed outside the vertical drive circuit 301 in FIG. 3, they may be disposed inside the vertical drive circuit 301 either.

Figure 4:
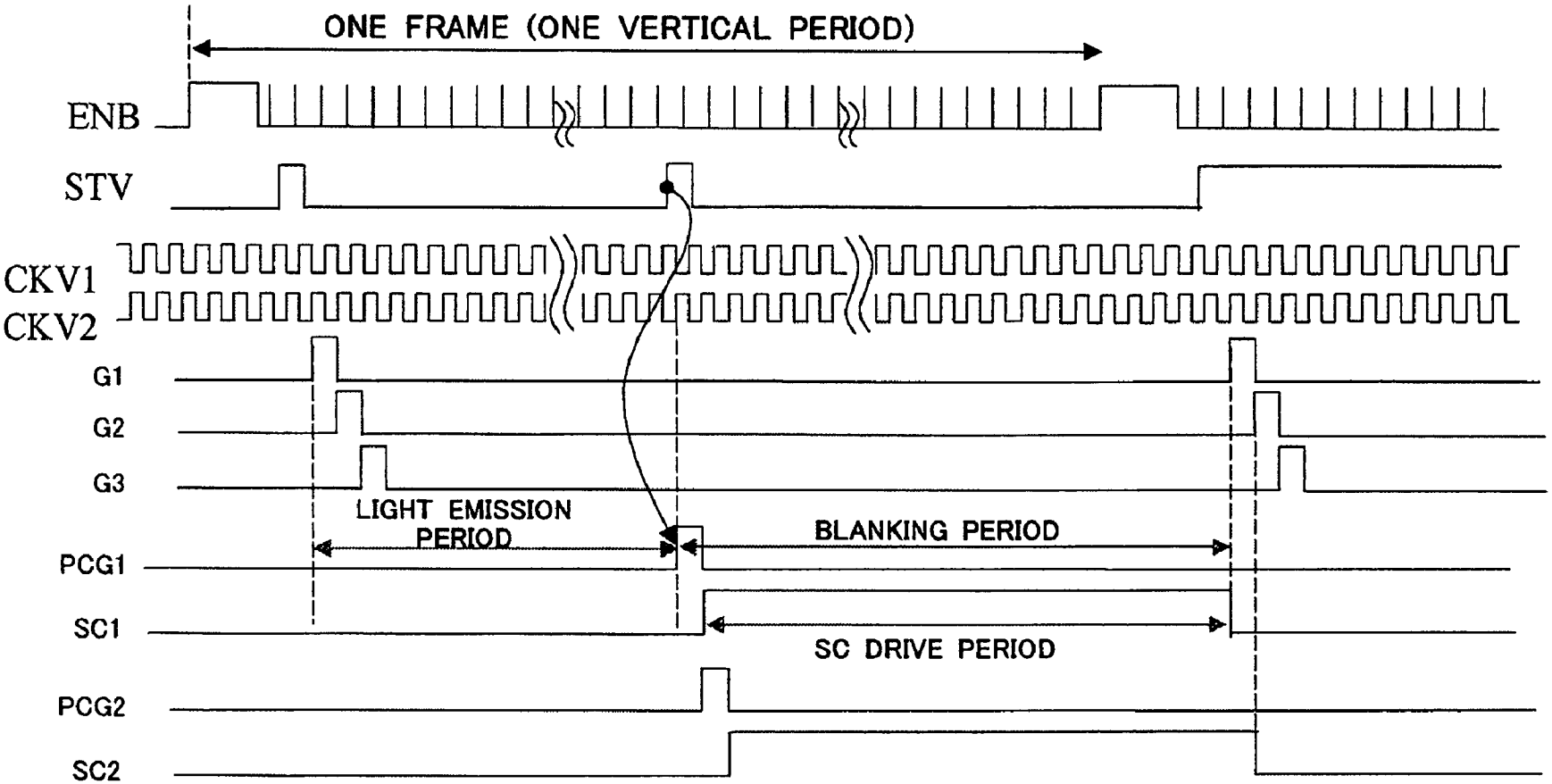
FIG. 4 is a timing chart showing a method to drive the organic EL display device according to the second embodiment of this invention.

Next, a driving method of the organic EL display device according to the second embodiment will be explained referring to the drawings. FIG. 4 is a timing chart to explain the driving method of the organic EL display device according to the second embodiment. The pixel selection signals G1, G2 and G3 are sequentially outputted from the vertical drive circuit 301 in synchronization with a rising edge of the first vertical start pulse signal STV.

With this, as in the first embodiment, the display signal D is written into each of the pixels in the first, second and third rows, one after another. And when the second vertical start pulse signal STV turns to the high level, the pre-charge pulse signal PCG1 for the first row is outputted from the control circuit 305. The pre-charge TFT 220 is turned on in response to the pre-charge pulse signal PCG1. The rest of the operation is the same as in the first embodiment. The storage capacitor control pulse signal SC1 turns to the high level when the pre-charge pulse signal PCG1 turns to the low level. And the electric characteristics of the driver TFT 214 are initialized during the non-light-emitting period of the organic EL device 216.

The operation is similar with the pixel 210B in the second row. The pre-charge pulse signal PCG2 for the second row rises when the pre-charge pulse signal PCG1 for the first row turns to the low level. When the pre-charge pulse signal PCG2 turns to the low level, the storage capacitor control pulse signal SC2 turns to the high level. And the electric characteristics of the driver TFT 214 are initialized during the non-light-emitting period of the organic EL device 216. The operation is similar with the pixels in the third row and in the rest of the rows.

Although two vertical start pulse signals STV are inputted in the second embodiment, three or more than three vertical start pulse signals STV may be inputted. The duration of the non-light-emitting period can be adjusted by counting the number of the vertical start pulse signals STV with the pulse counter 304.

Figure 5:
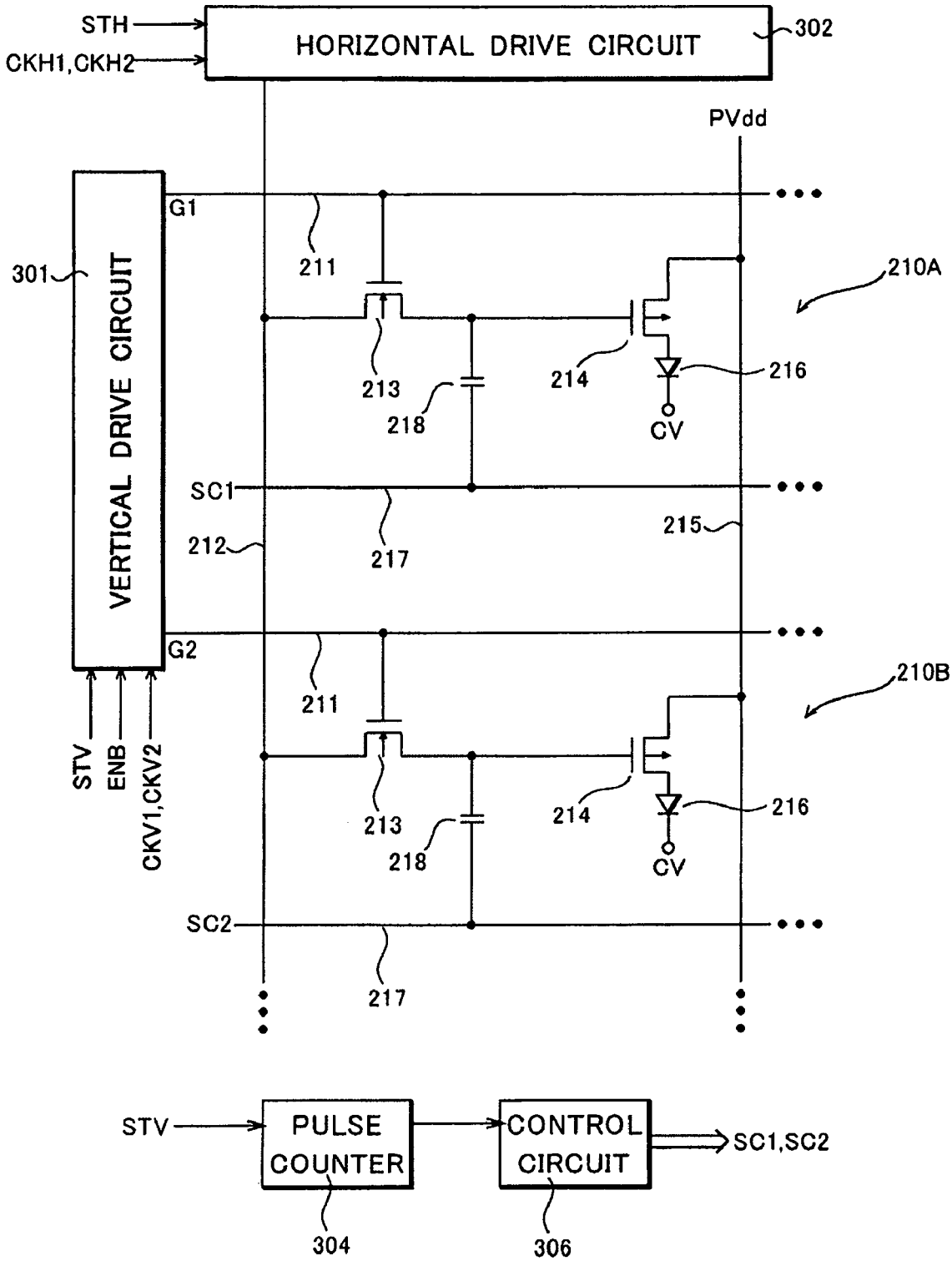
FIG. 5 is an equivalent circuit diagram of an organic EL display device according to a third embodiment of this invention.

Next, an active matrix type organic EL display device according to a third embodiment of this invention will be described hereafter referring to the drawings. FIG. 5 is an equivalent circuit diagram of the organic EL display device. The pre-charge TFT 220 and the pre-charge signal line 221, that are provided to turn the driver TFT 214 off in the first and second embodiments, are omitted in the third embodiment. The pulse counter 304 that counts the number of the vertical start pulse signals STV is provided as in the second embodiment. When the pulse counter 304 counts two vertical start pulse signals STV, a control circuit 306 generates storage capacitor control pulse signals SC1 and SC2 based on the count. That is, the driver TFT 214 is turned off by activating the storage capacitor control pulse signals SC1 and SC2 to the high level in the third embodiment.

Figure 6:
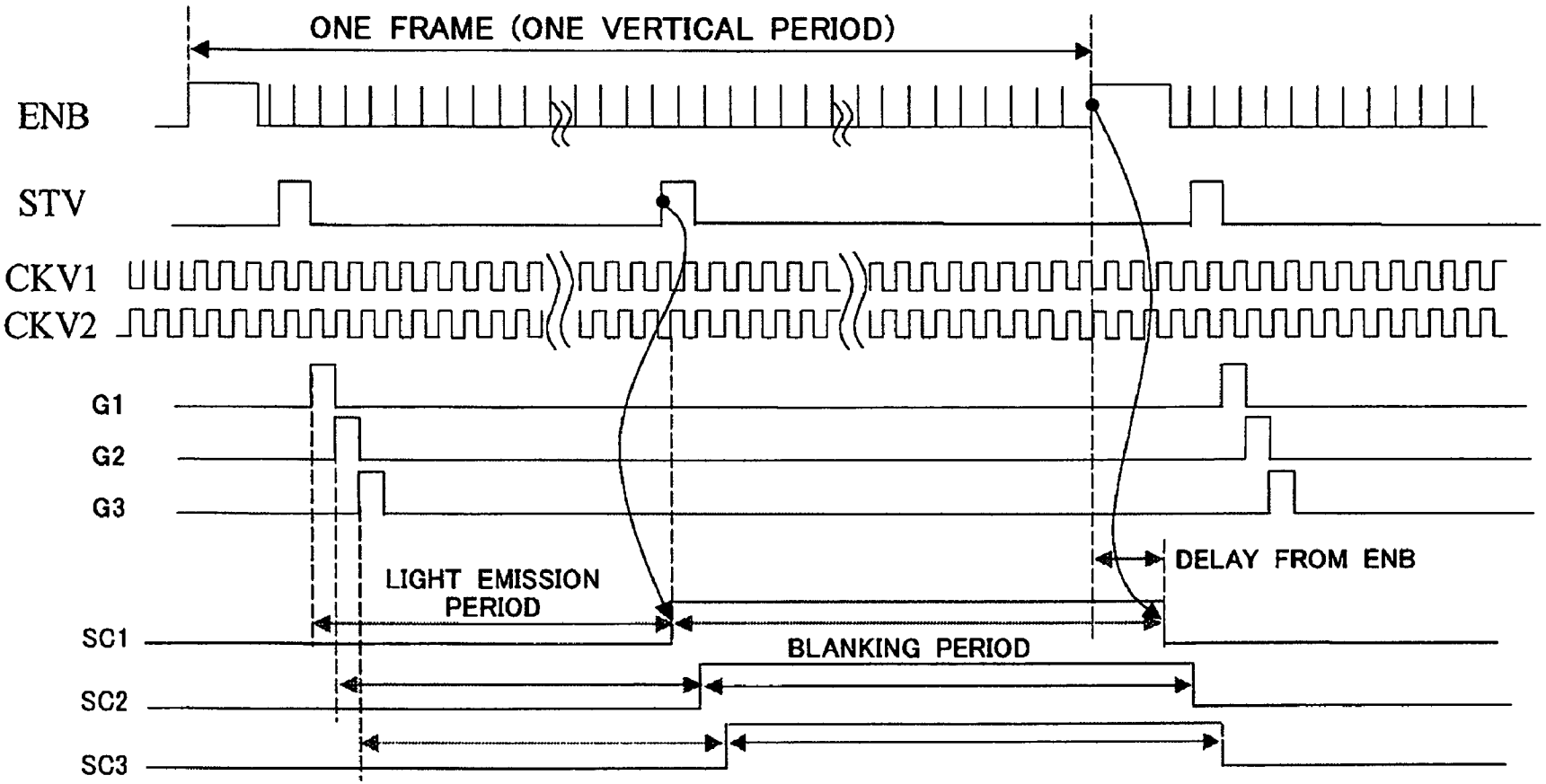
FIG. 6 is a timing chart showing a method to drive the organic EL display device according to the third embodiment of this invention.

Next, a driving method of the organic EL display device according to the third embodiment will be explained referring to the drawings. FIG. 6 is a timing chart to explain the driving method of the organic EL display device according to the third embodiment. Pixel selection signals G1, G2 and G3 are sequentially outputted from a vertical drive circuit 301 in synchronization with a rising edge of a first vertical start pulse signal STV.

A display signal D is written into a pixel in each of the first, second and third rows according to each of pixel selection signals G1, G2 and G3, and a light-emitting period of each of the rows begins accordingly. And when the second vertical start pulse signal STV turns to the high level, the storage capacitor control pulse signal SC1 for the first row outputted from the control circuit 306 turns to the high level. As a result, an electric potential at a gate of the driver TFT 214 is raised by capacitive coupling through a storage capacitor 218 according to a voltage change ΔV from a low level to the high level of the storage capacitor control pulse signal SC1. When the voltage change ΔV is large enough, the driver TFT 214, that is of P-channel type, is turned off and a non-light-emitting period of the organic EL device 216 begins. To be more specific, the driver TFT 214 turns off when an equation $Vs-Vg<Vt$ holds. Vs denotes an electric potential at a source of the driver TFT 214 and is equal to a positive power supply electric potential PVdd. Vg denotes the electric potential at the gate, which is raised in response to the voltage change ΔV, and Vt denotes an absolute value of a threshold voltage of the driver TFT 214.

And the storage capacitor control pulse signal SC1 is set to change from the high level to the low level to terminate the non-light-emitting period after a predetermined delay time from a rising edge of an enable signal ENB that is generated at a beginning of a subsequent vertical period.

The operation is similar with the pixel in the second row. After the storage capacitor control pulse signal SC1 for the first row rises to the high level, the storage capacitor control pulse signal SC2 for the second row rises to the high level to terminate the light-emitting period and start the non-light-emitting period of the pixel in the second row. The operation is similar with the pixel in the third row. After the storage capacitor control pulse signal SC2 for the second row rises to the high level, the storage capacitor control pulse signal SC3 for the third row rises to the high level to terminate the light-emitting period and start the non-light-emitting period of the pixel in the third row. The operation is similar with the pixels in the fourth row and in the rest of the rows. Note that a structure without the pre-charge TFT 220 and the pre-charge signal line 221 as in the third embodiment may be applied to the first embodiment as well.

Figure 7:
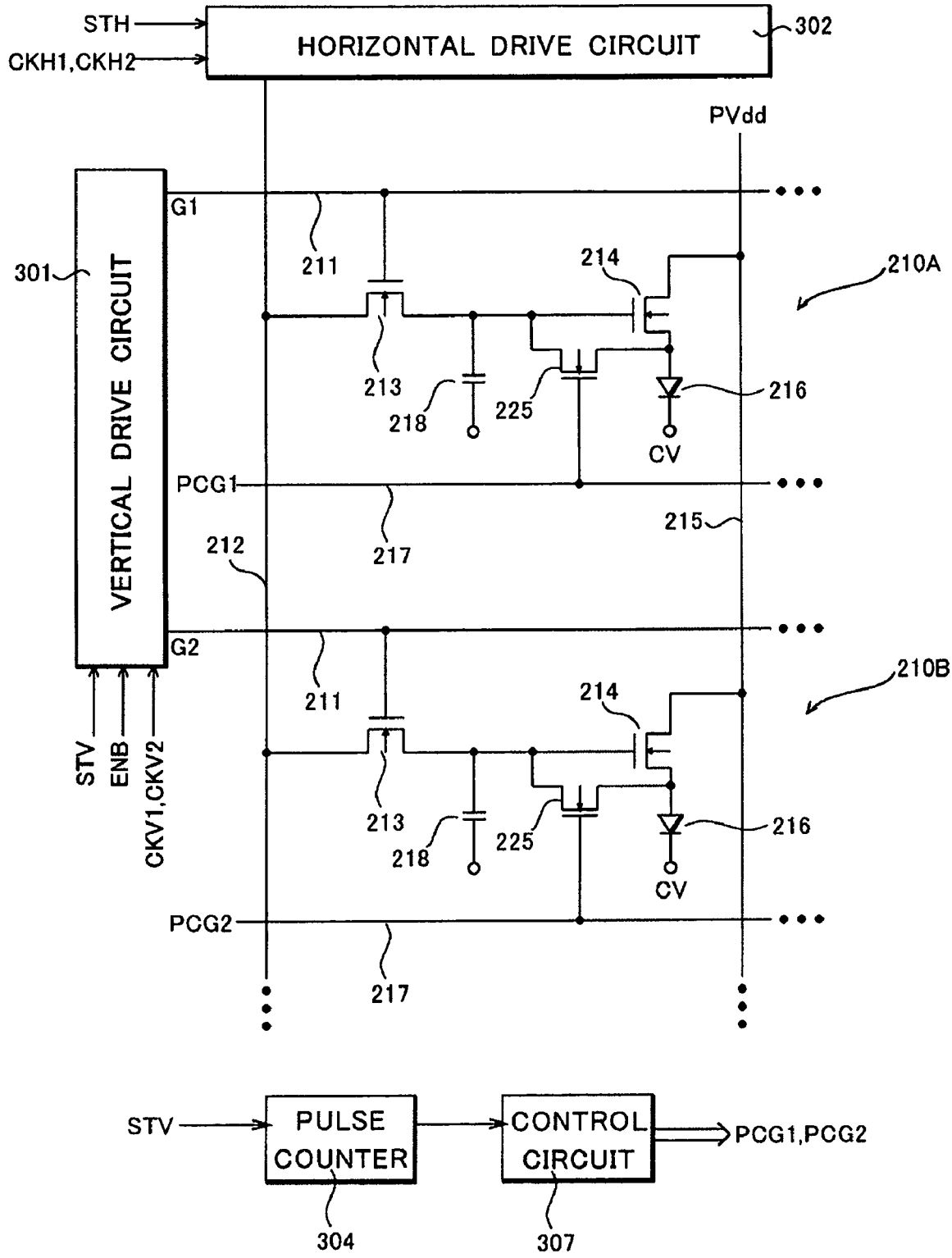
FIG. 7 is an equivalent circuit diagram of an organic EL display device according to a fourth embodiment of this invention.

Next, an active matrix type organic EL display device according to a fourth embodiment of this invention will be described hereafter referring to the drawings. FIG. 7 is an equivalent circuit diagram of the organic EL display device. The driver TFT 214 of P-channel type in the second embodiment is replaced with a driver TFT 214 of N-channel type in the fourth embodiment. Consequently, connections with the pre-charge TFT 225 are changed as shown in FIG. 7.

Figure 8:
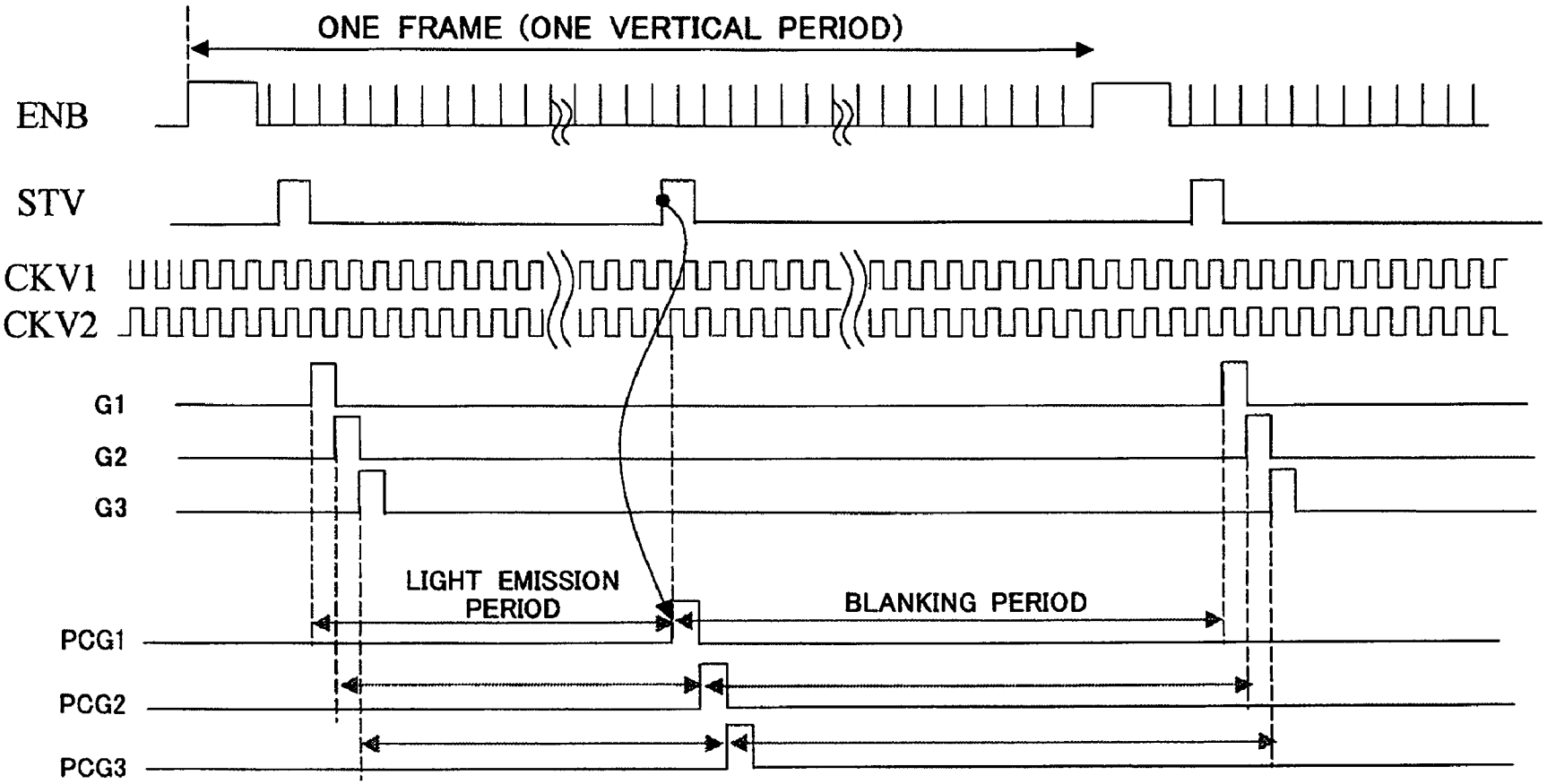
FIG. 8 is a timing chart showing a method to drive the organic EL display device according to the fourth embodiment of this invention.

Next, a driving method of the organic EL display device according to the fourth embodiment will be explained referring to the drawings. FIG. 8 is a timing chart to explain the driving method of the organic EL display device according to the fourth embodiment. Pixel selection signals G1, G2 and G3 are sequentially outputted from a vertical drive circuit 301 in synchronization with a rising edge of a first vertical start pulse signal STV.

With this, as in the second embodiment, a display signal D is written into each of pixels in first, second and third rows one after another, and a light-emitting period of each of the rows begins accordingly. And when a second vertical start pulse signal STV turns to a high level, a pre-charge pulse signal PCG1 for the first row is outputted from a control circuit 307.

A pre-charge TFT 225 is turned on in response to the pre-charge pulse signal PCG1. As a result, a source and a gate of the driver TFT 214 are short-circuited, an electric potential at the gate of the driver TFT 214 becomes the same electric potential as an electric potential at the source, and the driver TFT 214 is turned off. With this, an organic EL device 216 is extinguished to terminate the light-emitting period and commence a non-light-emitting period that lasts until the pixel selection signal G1 turns to a high level in a subsequent vertical period. Note that replacing the driver TFT 214 of P-channel type with the driver TFT 214 of N-channel type may be applied to the first embodiment as well.

Figure 10:
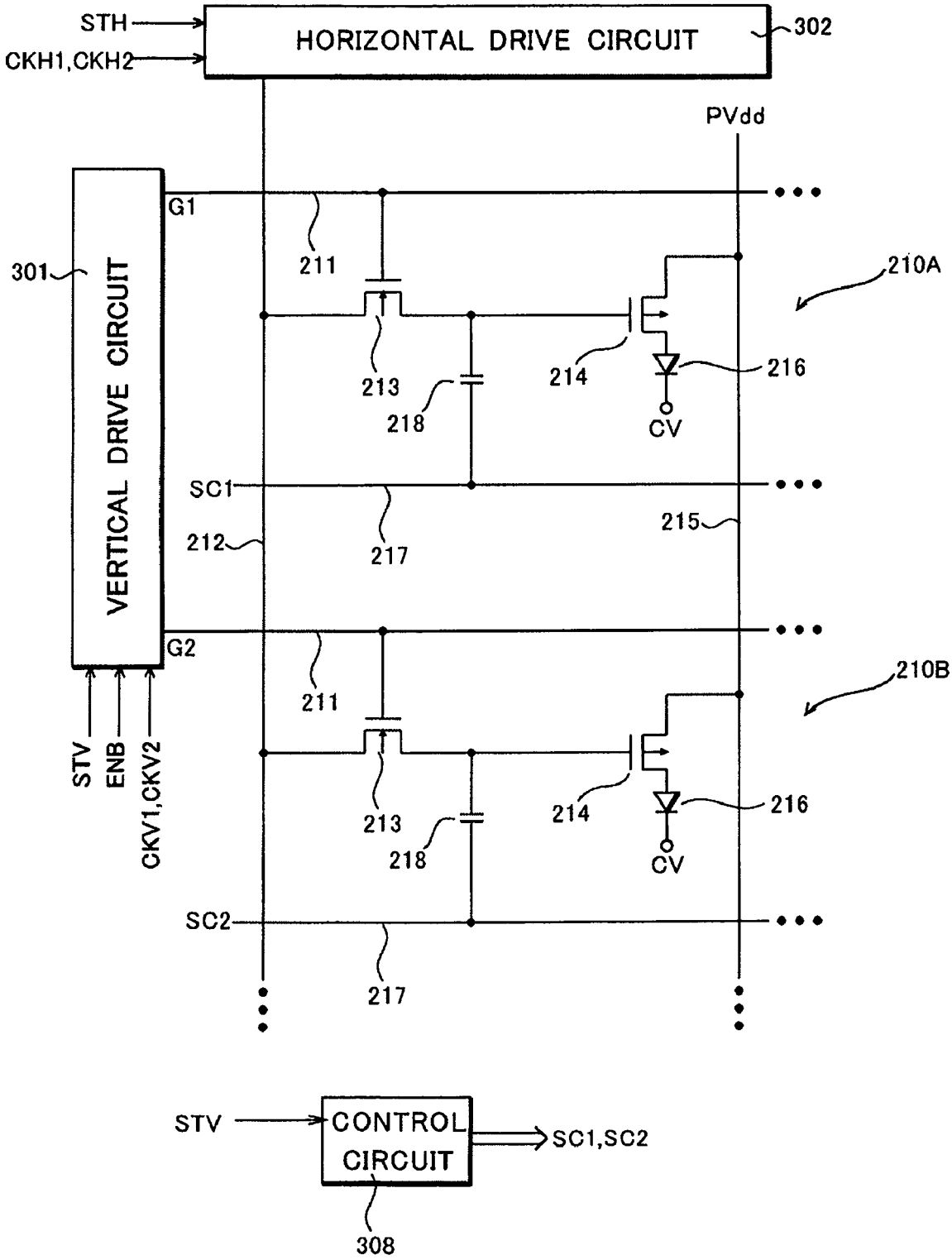
FIG. 10 is an equivalent circuit diagram of an organic EL display device according to a fifth embodiment of this invention.

Next, an active matrix type organic EL display device according to a fifth embodiment of this invention will be described hereafter referring to the drawings. FIG. 10 is an equivalent circuit diagram of the organic EL display device. In the fifth embodiment, the pre-charge TFT 220 and the pre-charge signal line 221 are omitted as in the third embodiment. The fifth embodiment differs from the third embodiment in that the pulse counter 304 that counts the number of vertical start pulse signals STV is not provided in the fifth embodiment. And a control circuit 308 generates storage capacitor control pulse signals SC1 and SC2 in synchronization with a falling edge of a vertical start pulse signal STV. The driver TFT 214 is turned off to start a non-light-emitting period by activating the storage capacitor control pulse signals SC1 and SC2 to a high level.

Figure 11:
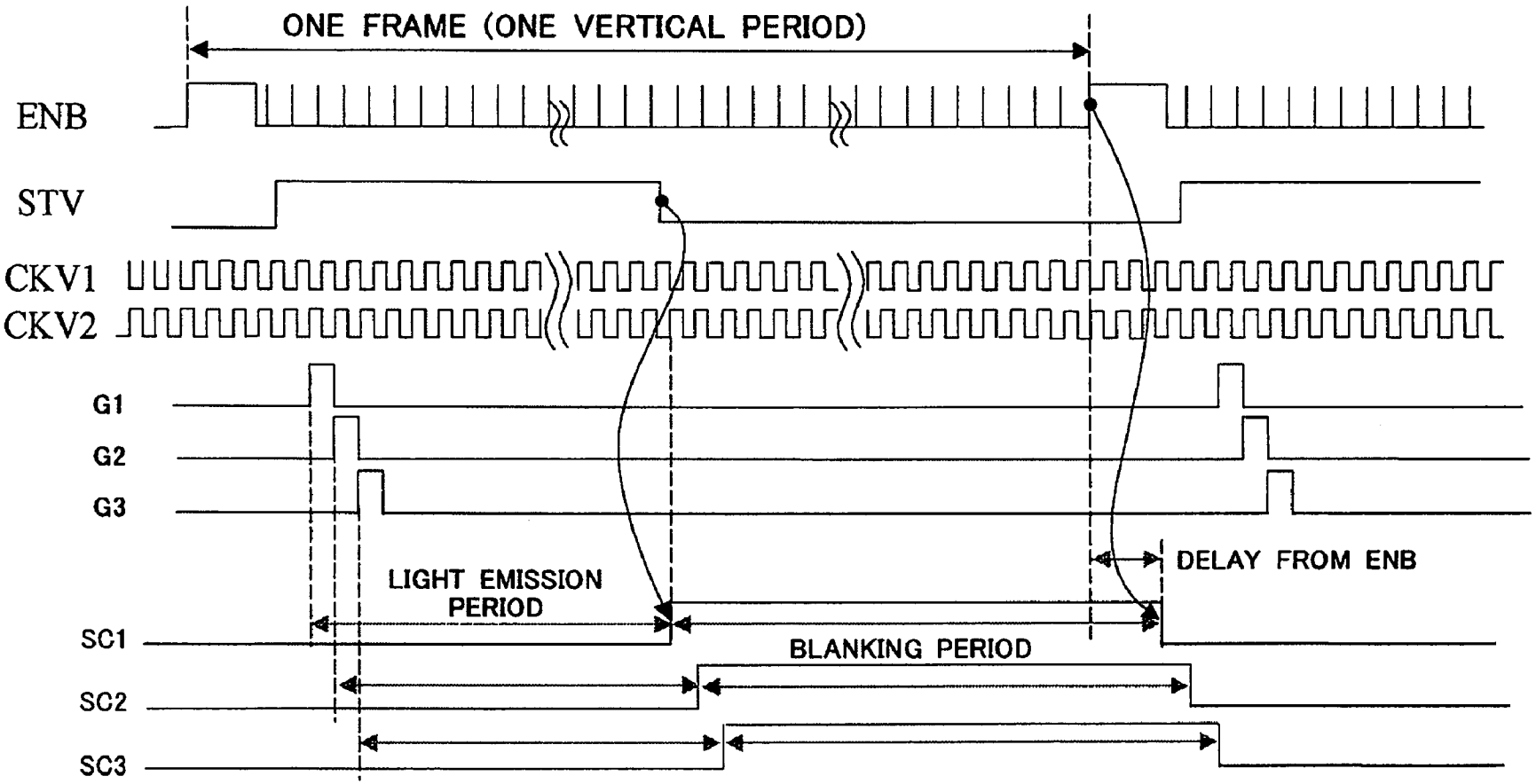
FIG. 11 is a timing chart showing a method to drive the organic EL display device according to the fifth embodiment of this invention.

Next, a driving method of the organic EL display device according to the fifth embodiment will be explained referring to the drawings. FIG. 11 is a timing chart to explain the driving method of the organic EL display device according to the fifth embodiment. Pixel selection signals G1, G2 and G3 are sequentially outputted from a vertical drive circuit 301 in synchronization with a rising edge to a high level of a first vertical start pulse signal STV.

A display signal D is written into a pixel in each of the first, second and third rows according to each of pixel selection signals G1, G2 and G3, and a light-emitting period of each of the rows begins accordingly. And when the vertical start pulse signal STV turns to a low level, the storage capacitor control pulse signal SC1 for the first row outputted from the control circuit 308 turns to the high level. As a result, an electric potential at a gate of a driver TFT 214 is raised by capacitive coupling through a storage capacitor 218 according to a voltage change ΔV from a low level to the high level of the storage capacitor control pulse signal SC1. When the voltage change ΔV is large enough, the driver TFT 214, that is of P-channel type, is turned off and the non-light-emitting period of the organic EL device 216 begins. To be more specific, the driver TFT 214 turns off when an equation $Vs-Vg<Vt$ holds. Vs denotes an electric potential at a source of the driver TFT 214 and is equal to a positive power supply electric potential PVdd. Vg denotes the electric potential at the gate, which is raised in response to the voltage change ΔV, and Vt denotes an absolute value of a threshold voltage of the driver TFT 214. And the storage capacitor control pulse signal SC1 is set to change from the high level to the low level to terminate the non-light-emitting period after a predetermined delay time from a rising edge of the enable signal ENB that is generated at a beginning of a subsequent vertical period.

The operation is similar with the pixel in the second row. After the storage capacitor control pulse signal SC1 for the first row rises to the high level, the storage capacitor control pulse signal SC2 for the second row rises to the high level to terminate the light-emitting period and start the non-light-emitting period of the pixel in the second row. The operation is similar with the pixel in the third row. After the storage capacitor control pulse signal SC2 for the second row rises to the high level, the storage capacitor control pulse signal SC3 for the third row rises to the high level to terminate the light-emitting period and start the non-light-emitting period of the pixel in the third row. The operation is similar with the pixels in the fourth row and in the rest of the rows.

Although the above embodiments are described taking examples in which the display device is formed of voltage-driven type pixel circuit and the display signal D is a voltage signal, these embodiments may be applied to a current-driven type pixel circuit as well. In this case, the display signal D is to be a current signal.

According to the embodiments described above, the light-emitting period of each of the organic EL devices 216 can be freely adjusted through the use of the vertical start pulse signal STV. The variation in brightness on the display panel and the duration of the residual image can be reduced to improve quality of moving picture display by the adjustment described above. Also, these embodiments are effective in reducing time and cost for development of a display device, because finding an optimum light-emitting period is made possible in a development phase of the display device. Furthermore, by making the control method of the light-emitting period open to the user of the display device, the user can apply a display panel of certain specifications to an application suitable for his purpose. For example, the light-emitting period can be made shorter for better response in displaying a moving picture when the display panel is used in a camcorder which is mainly used for moving picture, while the light-emitting period can be made longer to prevent a flicker when the display panel is used in a still camera.

In these embodiments, the light-emitting period and the non-light-emitting period of the light-emitting device in an active matrix type display device can be freely adjusted through the use of the vertical start pulse signal. The variation in brightness on the display panel and the duration of the residual image can be reduced to improve the quality of display by the adjustment.

What is claimed is:

1. An active matrix type display device comprising:

a plurality of pixels arrayed in a matrix form, each of the pixels comprising a pixel selection transistor, a light-emitting device and a driver transistor that drives the light-emitting device according to a display signal supplied through the pixel selection transistor;

a vertical driver circuit generating a pixel selection signal in response to a first change in a vertical start pulse signal; and a control circuit that turns off the driver transistor in response to a second change in the vertical start pulse signal.

2. The active matrix type display device of claim 1, wherein the control circuit is configured to turn the driver transistor off in response to a change in a level of the vertical start pulse signal.

3. An active matrix type display device comprising:

a plurality of pixels arrayed in a matrix form, each of the pixels comprising a pixel selection transistor, a light-emitting device and a driver transistor that drives the light-emitting device according to a display signal supplied through the pixel selection transistor;

a vertical driver circuit receiving in one frame period a first vertical start pulse signal and a second vertical start pulse signal which is different from the first vertical start pulse signal and comes after the first vertical start pulse signal in the one frame period;

a counter circuit that counts the vertical start pulse signals; and a control circuit turning the driver transistor off when the counter circuit counts the second vertical start pulse signal.

4. An active matrix type display device comprising:

a plurality of pixels arrayed in a matrix form, each of the pixels comprising a pixel selection transistor, a light-emitting device receiving a power voltage from a power supply line, a driver transistor that drives the light-emitting device according to a display signal supplied through the pixel selection transistor, a storage capacitor that is connected between a gate of the driver transistor and a capacitor line and retains the display signal, and a pre-charge transistor that is turned on according to a pre-charge pulse signal to short-circuit the gate and a source of the driver transistor, the power supply line being different from the capacitor line; and a control circuit that turns the pre-charge transistor on for a predetermined period by outputting the pre-charge pulse signal in response to a vertical start pulse signal.

5. The active matrix type display device of claim 4, wherein the control circuit is configured to change an electric potential at the gate of the driver transistor with respect to an electric potential at the source of the driver transistor by outputting a storage capacitor control pulse signal to the capacitor line when the pre-charge transistor is turned off after the predetermined period.

6. The active matrix type display device of claim 4 or 5, wherein the control circuit is configured to output the pre-charge pulse signal in response to a change in a level of the vertical start pulse signal.

7. The active matrix type display device of claim 4 or 5, further comprising a counter circuit that counts the vertical start pulse signals, wherein the control circuit is configured to output the pre-charge pulse signal when a counting of the vertical start pulse signals reaches a predetermined number.

8. An active matrix type display device comprising:

a plurality of pixels arrayed in a matrix form, each of the pixels comprising a pixel selection transistor, a light-emitting device, a driver transistor that drives the light-emitting device according to a display signal supplied through the pixel selection transistor and a storage capacitor that is connected between a gate of the driver transistor and a capacitor line and retains the display signal;

a vertical driver circuit receiving in one frame period a first vertical start pulse signal and a second vertical start pulse signal which is different from the first vertical start pulse signal and comes after the first vertical start pulse signal in the one frame period; and a control circuit that changes an electric potential at the gate with respect to an electric potential at a source of the driver transistor so as to turn the driver transistor off by outputting a storage capacitor control pulse signal to the capacitor line in response to the second vertical start pulse signal.

9. The active matrix type display device of claim 1, 2, 3, 4 or 8, wherein the light-emitting device comprises an organic electroluminescent device.

10. The active matrix type display device of claim 1, wherein the a pulse width of the vertical start pulse signal is adjustable.

11. The active matrix type display device of claim 1, the vertical driver circuit is configured to start a vertical scan period for a light-emitting period in response to the first change in the vertical start pulse signal and another vertical scan period for a non-light-emitting period in response to the second change in the vertical start pulse signal.

12. The active matrix type display device of claim 3, wherein vertical driver circuit is configured to start a vertical scan period for a light-emitting period in response to the first vertical start pulse signal and another vertical scan period for a non-light-emitting period in response to the second vertical start pulse signal.

13. The active matrix type display device of claim 12, wherein the light-emitting devices emit light during the light-emitting period and are turned off sequentially during the non-light-emitting period.

14. The active matrix type display device of claim 13, wherein a gate and source of the driver transistor is short circuited to turn off the light-emitting device.

* * * * *